US006274297B1

(12) United States Patent
Uytterhoeven et al.

(10) Patent No.: US 6,274,297 B1
(45) Date of Patent: Aug. 14, 2001

(54) PHOTOTHERMOGRAPHIC RECORDING MATERIAL WITH IN-SITU AND EX-SITU PHOTOSENSITIVE SILVER HALIDE AND A SUBSTANTIALLY LIGHT-INSENSITIVE ORGANIC SALT

(75) Inventors: Herman Uytterhoeven, Bonheiden; Luc Bastiaens, Brasschaat; Luc Vissers, Brecht; Yvan Gilliams, Hever; Chris Van Roost, Aartselaar, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/210,913

(22) Filed: Dec. 14, 1998

Related U.S. Application Data

(60) Provisional application No. 60/072,674, filed on Jan. 27, 1998, now abandoned.

(30) Foreign Application Priority Data

Dec. 12, 1997 (EP) ..... 97203907

(51) Int. Cl.[7] ..... G03C 1/492
(52) U.S. Cl. ..... 430/350; 430/619
(58) Field of Search ..... 430/619, 350, 430/617

(56) References Cited

U.S. PATENT DOCUMENTS

| | | | | |
|---|---|---|---|---|
| 3,871,887 | * | 3/1975 | Jones . | |
| 4,435,499 | | 3/1984 | Reeves | 430/350 |
| 4,784,939 | * | 11/1988 | Van Pham | 430/607 |
| 5,382,504 | | 1/1995 | Shor et al. | 430/619 |
| 5,434,043 | | 7/1995 | Zou et al. | 430/619 |

FOREIGN PATENT DOCUMENTS

| | | |
|---|---|---|
| 0809141 | 11/1997 | (EP) . |
| 9704355 | 2/1997 | (WO) . |

OTHER PUBLICATIONS

"The Influence of the Photosensitive Silver Halide/Silver Carboxylate Preparation conditions on the Morphology of Thermally Developed Silver Particles" by Bokhonov et al.; Journal of Imaging Science and Technology, vol. 40, No. 5, Sep./Oct. 1996, pp. 417–422.

* cited by examiner

*Primary Examiner*—Thorl Chea
(74) *Attorney, Agent, or Firm*—Baker Botts L.L.P.

(57) ABSTRACT

A production process for a photothermographic recording material thermally developable under substantially water-free conditions comprising the steps of: (i) providing a support; (ii) producing one or more aqueous dispersions or solutions containing together a substantially light-insensitive organic silver salt, photosensitive ex-situ silver halide in catalytic association with the substantially light-insensitive organic silver salt, a reducing agent in thermal working relationship with the substantially light-insensitive organic silver salt and a binder; (iii) coating the one or more aqueous dispersions or solutions onto the support to form layers which upon drying become a photo-addressable thermally developable element; and (iv) drying the layers, wherein the photo-addressable thermally developable element contains between 0.2 and 2.5 moles of in-situ photosensitive silver iodide per mole of ex-situ photosensitive silver halide produced by reacting particles of the substantially light-insensitive organic silver salt in an aqueous dispersion with a source of iodide ion; and a recording process therefor.

13 Claims, 3 Drawing Sheets

Figure 1:
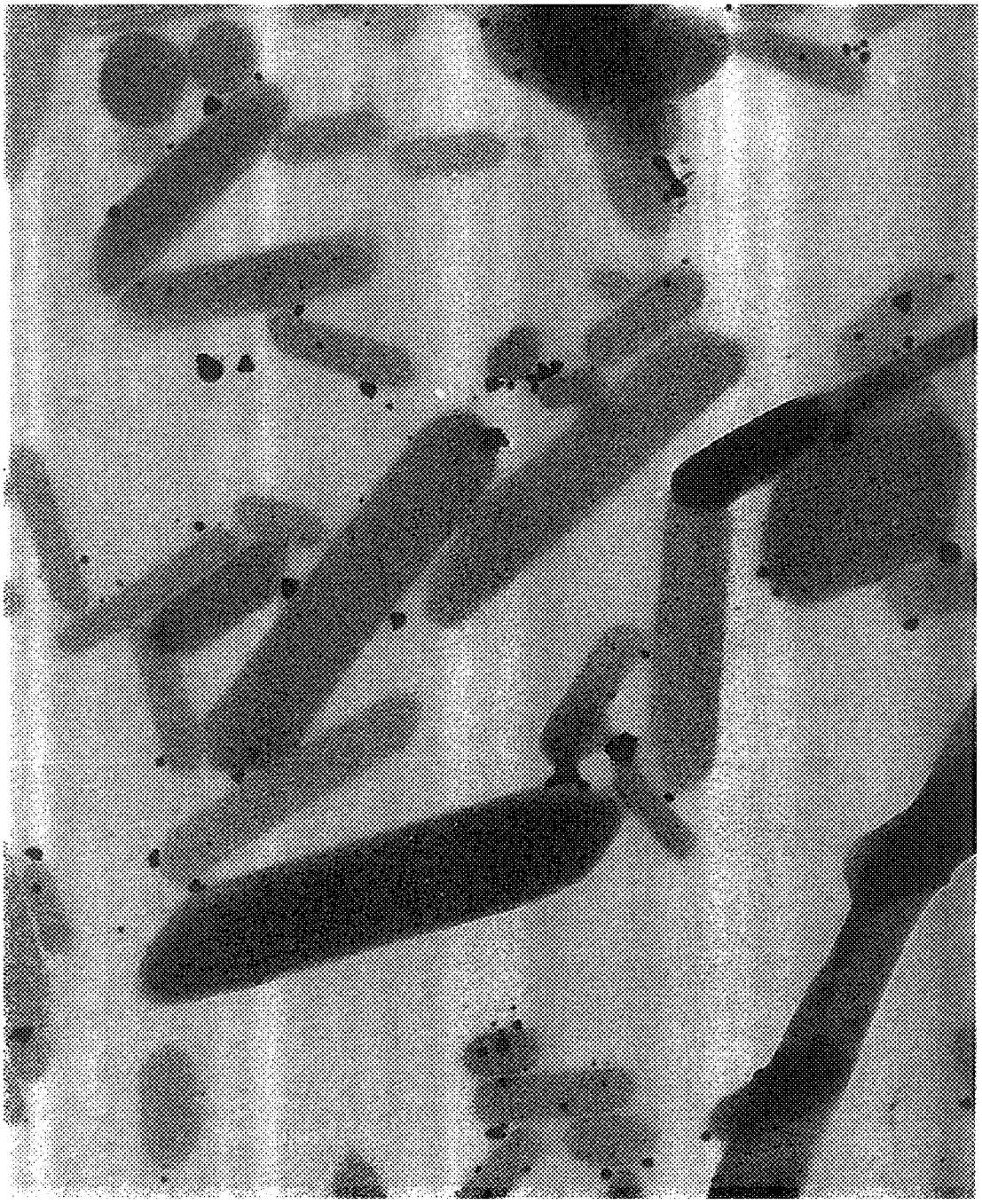

PHOTOTHERMOGRAPHIC RECORDING MATERIAL WITH IN-SITU AND EX-SITU PHOTOSENSITIVE SILVER HALIDE AND A SUBSTANTIALLY LIGHT-INSENSITIVE ORGANIC SALT

The application claims the benefit of the U.S. Provisional Application No. 60/072,674 filed Jan. 27, 1998 abandoned.

DESCRIPTION

1. Field of the Invention

The present invention relates to a photothermographic recording material with improved sensitivity and contrast.

2. Background of the Invention

U.S. Pat. No. 3,457,075 discloses a sheet material useful in imaging by a process involving exposure to a light-image followed by uniform heating and including a stratum containing (a) photosensitive silver halide catalyst-forming means and (b) heat-sensitive reactant image-forming means including (1) a water-insoluble silver salt of a long chain fatty acid as an oxidizing agent, and (2) a reducing agent for silver ion, the oxidation-reduction reaction of which to produce a visible change is accelerated by the catalyst; the stratum being further characterized in that a sufficient quantity, of at least about one-fourth mol percent based on the fatty acid silver salt, of the photosensitive means is in catalytic proximity with a sufficient proportion of the heat-sensitive means to provide a gamma infinity value of at least about 0.5 when the stratum is exposed image-wise to the light-image and the image is then developed by uniform heating and wherein the manufacture method for the sheet material comprises mixing with the fatty acid silver salt a source of halide ions under conditions permitting reaction therebetween with formation of the silver halide catalyst-forming means. As sources of halide ions for the conversion of organic silver salts to silver halides GB 1,547,326 lists: inorganic halides, halogen-containing metal complexes, onium halides (for example quaternary ammonium halides, quaternary phosphonium halides and ternary sulfonium halides), halogenated hydrocarbons, N-halo compounds and other halogen-containing compounds.

WO 97/48014 discloses a production method for a photothermographic recording material comprising the steps of: (i) providing a support; (ii) coating the support with a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterized in that the photosensitive silver halide is formed by reacting an aqueous emulsion of particles of the substantially light-insensitive organic silver salt with at least one onium salt with halide or polyhalide anion(s) and that the photo-addressable thermally developable element is coated from an aqueous dispersion medium.

WO 97/48015 discloses a photothermographic recording material comprising a photo-addressable thermally developable element coatable from aqueous media comprising a substantially light-insensitive organic silver salt, photosensitive silver halide in catalytic association with the substantially light-insensitive organic silver salt and a reducing agent in thermal working relationship with the substantially light-insensitive organic silver salt and a binder, characterized in that the binder comprises a water soluble polymer, a water-dispersible polymer or a mixture of a water soluble polymer and a water-dispersible polymer and particles of the photosensitive silver halide are non-aggregating in the photo-addressable thermally developable element and are uniformly distributed over and between particles of the substantially light-insensitive organic silver salt, at least 80% by number of the particles having a diameter, determined by transmission electron microscopy, of <40 nm.

U.S. Pat. No. 3,871,887 discloses a method of preparing a photothermographic composition comprising: A) preparing a dispersion of: a) an oxidation-reduction image-forming combination comprising: i) a silver salt oxidizing agent and ii) an organic reducing agent with: b) ex-situ synthetic polymer-peptized photosensitive silver halide, and c) a cyclic imide toner in d) a non-gelatin polymeric binder and B) mixing with the dispersion a sensitizing concentration of a non-silver iodide salt, the iodide salt having the property of increasing the photosensitvity of the photothermographic composition.

However, there is a need for photothermographic recording materials with still higher photosensitivities than those achievable using the teaching of WO 97/48014 and WO 97/48015 in particular for photothermographic recording materials coated from aqueous solutions and dispersions. Further desirable aims are improvement in contrast and a reduction in the amount of photosensitive silver halide necessary to achieve the required photosensitivity in photothermographic materials based on a substantially light-insensitive organic silver salt, photosensitive silver halide in catalytic association with the organic silver salt and a reducing agent for the organic silver salt. A reduction in the amount of silver halide would increase the intrinsic stability of such materials and hence their photosensitivity (or the amount of silver halide necessary to attain the same photosensitivity), since this reduces the amount of stabilizer necessary to achieve acceptable pre- and post-exposure stability and hence the degree of stabilizer-induced photosensitivity loss.

OBJECTION OF THE INVENTION

It is therefore a first object of the invention to provide a process for producing a photothermographic recording material comprising a photo-addressable thermally developable element based on a substantially light-insensitive organic silver salt, photosensitive silver halide in catalytic association with the organic silver salt and a reducing agent for the organic silver salt with increased photosensitivity by coating from an aqueous medium.

It is a second object of the invention to provide a photothermographic recording material comprising a photo-addressable thermally developable element based on a substantially light-insensitive organic silver salt, photosensitive silver halide in catalytic association with the organic silver salt and a reducing agent for the organic silver salt having an increased photosensitivity.

It is a still further object of the invention to provide a recording process for a thermographic recording material with the above improved characteristics.

Further objects and advantages of the invention will become apparent from the description hereinafter.

SUMMARY OF THE INVENTION

In variance to U.S. Pat. No. 3,871,887 in which the invention examples show that no significant change in photosensitivity was realized by varying the added iodide between 0.05 and 0.25 moles per mole ex-situ photosensitive silver bromide with photothermographic image-forming elements coated from solvent media, it has been surprisingly found by the inventors that with photothermographic image-forming elements coated from aqueous media the photosensitivity increased strongly with iodide concentration, the optimum iodide concentration being greater than 0.25 moles per mole ex-situ photosensitive silver halide.

The above-mentioned objects of the present invention, were realized by providing a production process for a photothermographic recording material thermally developable under substantially water-free conditions comprising the steps of: (i) providing a support; (ii) producing one or more aqueous dispersions or solutions containing together a substantially light-insensitive organic silver salt, photosensitive ex-situ silver halide in catalytic association with the substantially light-insensitive organic silver salt, a reducing agent in thermal working relationship with the substantially light-insensitive organic silver salt and a binder; (iii) coating the one or more aqueous dispersions or solutions onto the support to form layers which upon drying become a photo-addressable thermally developable element; and (iv) drying the layers, wherein the photo-addressable thermally developable element contains between 0.2 and 2.5 moles of in-situ photosensitive silver iodide per mole of ex-situ photosensitive silver halide produced by reacting particles of the substantially light-insensitive organic silver salt in an aqueous dispersion with a source of iodide ions.

A photothermographic recording material thermally developable under substantially water-free conditions is also provided according to the present invention comprising a photo-addressable thermally developable element comprising a substantially light-insensitive organic silver salt, photosensitive silver halide in catalytic association with the substantially light-insensitive organic silver salt and a reducing agent in thermal working relationship with the substantially light-insensitive organic silver salt and a binder, wherein part of the photosensitive silver halide is ex situ and part of the silver halide is in situ and the ex-situ and in-situ photosensitive silver halide is to be found in separate layers.

A recording process is further provided according to the present invention comprising the steps of: (i) providing a photothermographic recording material as described above; (ii) bringing the recording material into the proximity of a source of actinic radiation to which it is sensitive; (iii) image-wise exposing the recording material to the actinic radiation; (iv) bringing the image-wise exposed recording material into proximity with a heat source; (v) thermally developing the image-wise exposed recording material under substantially water-free conditions; and (vi) removing the thermally developed image-wise exposed recording material from the heat source.

Preferred embodiments of the present invention are disclosed in the dependent claims.

DETAILED DESCRIPTION OF THE INVENTION

The invention is described hereinafter by way of examples with reference to the accompanying figures wherein:

FIG. 1: Transmission electron micrograph at a magnification of 100,000× of the silver behenate/ex-situ silver halide dispersion produced in the course of the preparation of the photothermographic recording material of COMPARATIVE EXAMPLE 6.

Figure 2:
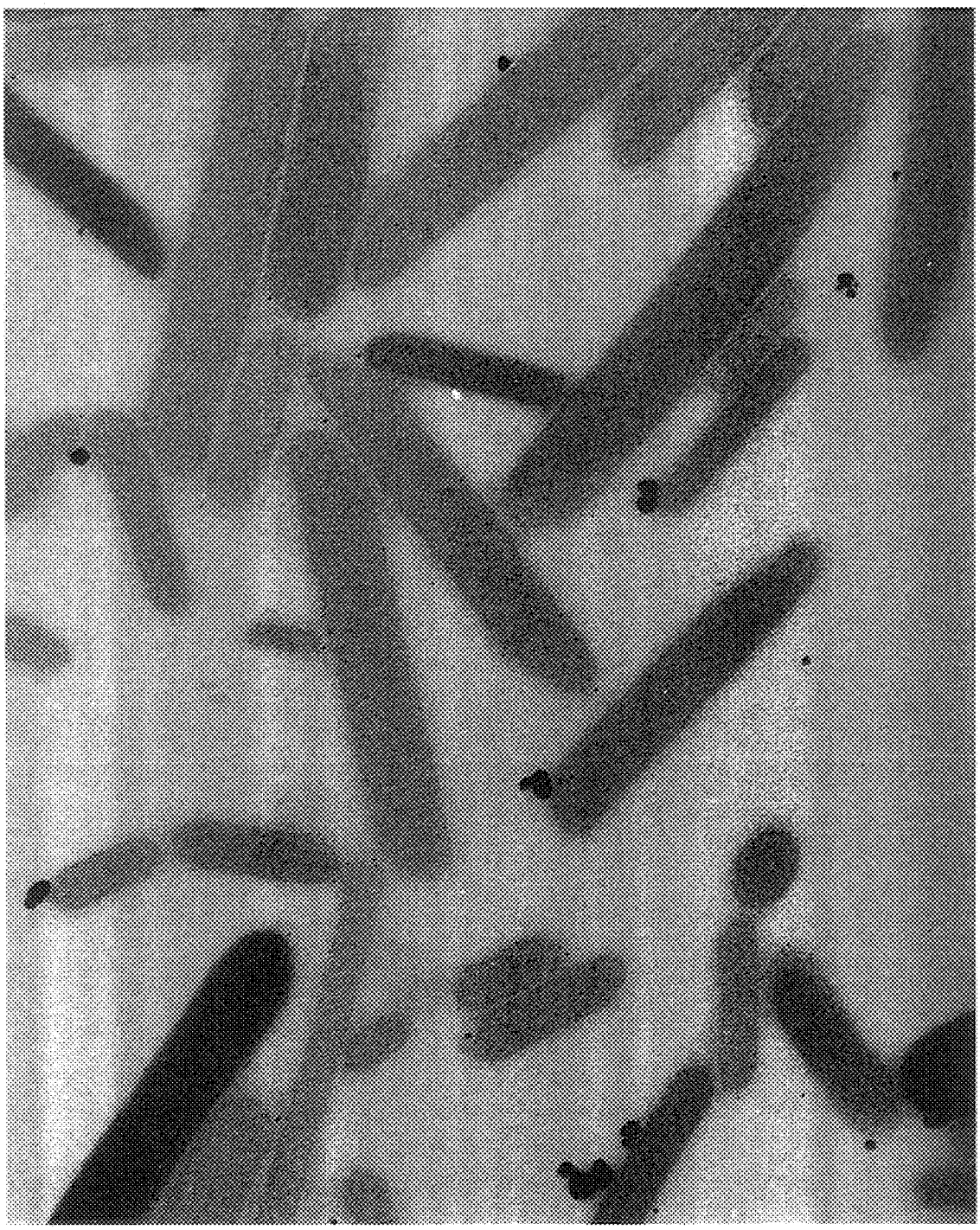

FIG. 2: Transmission electron micrograph at a magnification of 100,000× of the silver behenate/ex-situ silver halide+in-situ silver iodide dispersion produced in the course of the preparation of the photothermographic recording material of INVENTION EXAMPLE 21.

Figure 3:
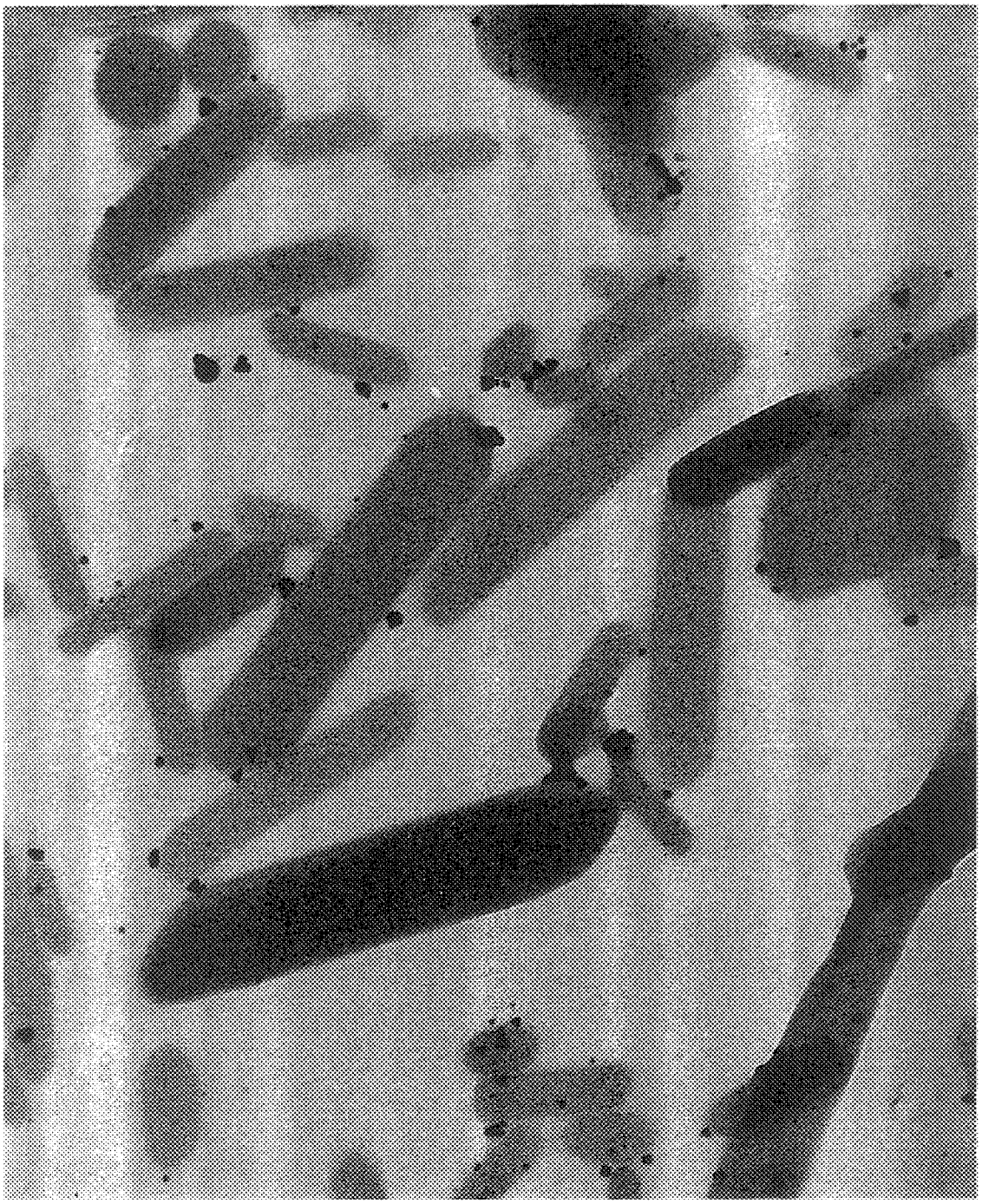

FIG. 3: Transmission electron micrograph at a magnification of 100,000× of the silver behenate/ex-situ silver halide+in-situ silver iodide+phenyl tribromomethyl sulfone dispersion produced in the course of the preparation of the photothermographic recording material of INVENTION EXAMPLE 22.

DEFINITIONS

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc.; glycols e.g. ethylene glycol; glycerine; N-methyl pyrrolidone; methoxypropanol; and ketones e.g. 2-propanone and 2-butanone etc.

By substantially light-insensitive is meant not intentionally light sensitive.

By thermally developable under substantially water-free conditions as used herein, means heating at a temperature of 80° to 250° C. under conditions in which the reaction system is approximately in equilibrium with water in the air, and water for inducing or promoting the reaction is not particularly or positively supplied from the exterior of the thermographic recording material. Such a condition is described in T. H. James, "The Theory of the Photographic Process, Fourth Edition, Macmillan 1977, page 374.

Photosensitive Silver Halide Particles

For photothermographic recording materials based on organic silver salts and reducing agents coated from aqueous media, it has been found that by using between 0.2 and 2.5 moles of in-situ formed silver iodide per mole photosensitive ex-situ silver halide, a surprising non-additive increase in photosensitivity has been achieved. In a preferred embodiment between 0.3 and 2.0 moles of in-situ formed silver iodide are used per mole photosensitive ex-situ silver halide, with 0.3 to 1.5 moles of in-situ formed silver iodide per mole of photosensitive silver halide being particularly preferred.

Transmission electron micrographs of dispersions of silver behenate/ex-situ silver halide and in-situ silver iodide produced in the presence of ex-situ silver halide show an entirely different distribution of silver halide particles in the silver behenate/silver halide dispersions compared with those obtained using ex-situ silver halide or in-situ silver iodide alone.

In a preferred embodiment of the present invention the ex-situ photosensitive silver halide and the in-situ photosensitive silver iodide are in catalytic association with the substantially light-insensitive organic silver salt in separate layers.

In another preferred embodiment of the present invention the in-situ formed photosensitive silver iodide is formed in the presence of the ex-situ photosensitive silver halide. Under these conditions it has been found that the poorly distributed and agglomerated ex-situ photosensitive silver halide particles are deagglomerated and epitaxial growth takes place by Ostwald ripening upon in-situ formation of photosensitive silver iodide.

According to the photothermographic recording material of the present invention, the photosensitive silver halide is preferably present in a concentration with respect to the substantially light-insensitive organic silver salt of between 0.1 and 50 mol %, with quantities between 3 and 35 mol % being particularly preferred and quantities between 5 and 20 mol % being especially preferred.

Ex-situ Photosensitive Silver Halide

In a preferred embodiment of the present invention the ex-situ photosensitive silver halide is silver bromide, silver chloride, silver iodide or a mixed crystal consisting of silver chloride and/or silver bromide and/or silver iodide.

In another preferred embodiment of the photothermographic material according to the present invention, the ex-situ photosensitive silver halide is present in a concentration with respect to the substantially light-insensitive organic silver salt of between 0.1 and 35 mol %.

In a further preferred embodiment of the photothermographic recording material of the present invention, at least 80% by volume of the particles of the ex-situ silver halide have a diameter determined by electron microscopy between 50 and 150 nm.

Ex-situ photosensitive silver halide may be produced according to any conventional process for example those described in Research Disclosure number 17029, published in June 1978, in section I.

In-situ Photosensitive Silver Iodide

In-situ photosensitive silver iodide is produced, as used in the photothermographic recording material of the present invention, by the reaction of organic silver salt particles with an iodide ion source in an aqueous medium. Suitable iodide ion sources are:

alkali and ammonium iodides e.g. KI, $NH_4I$ etc.;

onium salts with iodide or polyiodide anions

N-iodo compounds etc.

By onium salts is meant, according to the definition given in "McGraw-Hill Dictionary of Scientific and Technical Terms, Fourth Edition, edited by S P Parker, McGraw-Hill Book Company, New York (1989)": "chemical suffix indicating a complex cation". The iodide or polyiodide onium salts may be added as solids or solutions or may be formed in the aqueous dispersion of particles of the substantially light-insensitive silver salt by metathesis between a salt with iodide or polyiodide anions and onium salts with anions other than iodide or polyiodide.

Preferred oniums according to the present invention are organo-phosphonium, organo-sulphonium and organo-nitrogen onium cations, with heterocyclic nitrogen onium (e.g. pyridinium), quaternary phosphonium and ternary sulphonium cations being preferred.

Onium cations, according to the present invention, may be polymeric or non-polymeric. Preferred non-polymeric onium salts for partial conversion of particles of substantially light-insensitive organic silver salt into photo-sensitive silver halides according to the present invention are:

the nitrogen-onium polyiodides (NC):

NC10=N-dodecyl-pyridinium iodide

NC02=tetrabutylammonium iodide the quaternary phosphonium polyiodides (PC):

PC01=3-(triphenyl-phosphonium)propionic acid iodide

PC02=methyl-triphenyl-phosphonium iodide and the ternary sulfonium polyiodide: trimethylsulfonium iodide.

Source of Bromine or Chlorine Radicals

In a preferred embodiment of the photothermographic recording material according to the present invention, the photo-addressable thermally developable element further contains a source of bromine or chorine radicals. Suitable sources of bromine or chlorine radicals are disclosed in JN 50-089018, JN 50-137126, GB 2,006,976, U.S. Pat. No. 3,707,377, EP-A 631 176, EP-A 605 981, EP-A 600,587, U.S. Pat. No. 4,459,350, U.S. Pat. No. 5,340,712, U.S. Pat. No. 4,756,999, U.S. Pat. No. 4,546,075, U.S. Pat. No. 4,452,885 and EP-B 223 606. A particularly preferred source of bromine or chlorine radicals is an aryl haloalkylsulfone or heterocyclic haloalkylsulfone, with phenyl tribromomethyl sulfone being especially preferred.

Photo-addressable Thermally Developable Element

The photo-addressable thermally developable element, according to the present invention, contains a substantially light-insensitive organic silver salt, photosensitive silver halide in catalytic association with the substantially light-insensitive organic silver salt and a reducing agent in thermal working relationship with the substantially light-insensitive organic silver salt and a water soluble or water-dispersible binder. The element may comprise a layer system with the silver halide in catalytic association with the substantially light-insensitive organic silver salt ingredients, spectral sensitizer optionally together with a supersensitizer in sensitizing association with the silver halide particles and the other ingredients active in the thermal development process or pre-or post-development stabilization of the element being in the same layer or in other layers with the proviso that the organic reducing agent and the toning agent, if present, are in thermal working relationship with the substantially light-insensitive organic silver salt i.e. during the thermal development process the reducing agent and the toning agent, if present, are able to diffuse to the substantially light-insensitive organic silver salt.

Substantially Light-insensitive Organic Silver Salts

Preferred substantially light-insensitive organic silver salts, for use in the photothermographic recording materials of the present invention, are silver salts of organic carboxylic acids e.g. silver salts of aromatic carboxylic acids, such as silver benzoate, and silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". The use of silver salts of aliphatic carboxylic acids is particularly preferred in the photothermographic recording materials of the present invention. Combinations of different organic silver salts can also be used in the photothermographic materials of the present invention.

Production of Organic Silver Salt Dispersions

Particles of the silver salts of organic carboxylic acids are prepared by the reaction of a soluble silver salt with the organic carboxylic acid or a salt thereof. Research Disclosure number 17029, published in June 1978, in section II gives a survey of different methods of preparing organic heavy metal salts. In order to obtain a fine emulsion of an organic heavy metal salt, either the synthesis has to be carried out in an organic solvent medium as disclosed, for example, in U.S. Pat. No. 3,700,458 or in a mixture of water and a substantially water insoluble organic solvent as disclosed, for example, in U.S. Pat. No. 3,960,908 for silver carboxylates. A suspension of particles containing a substantially light-insensitive organic silver salt may be obtained by using a process, comprising simultaneous metered addition of a solution or suspension of an organic compound with at least one ionizable hydrogen atom or its salt; and a solution of a silver salt to a liquid, as described in EP-A 754 969. Should dispersion be necessary any conventional dispersion techniques may be used, for example ball milling, microfluidization, pearl mills etc.

A preferred production process for a dispersion of particles of substantially light-insensitive organic silver salt including silver behenate in an aqueous medium for use in the photothermographic recording material of the present invention comprises the steps of: i) producing an aqueous dispersion of one or more organic acids including behenic acid and an anionic surfactant; ii) substantially neutralizing the organic acids with aqueous alkali thereby forming organic acid salts including a behenic acid salt; (iii) adding an aqueous solution of a silver salt to completely convert the organic acid salts into their silver salts including silver behenate, characterized in that the anionic surfactant is present in a molar ratio with respect to organic acid greater than 0.15 and the silver salt is added at a rate between 0.025 mol/mol organic silver salt. min and 2.25 mol/mol organic silver salt.min.

Suitable anionic surfactants for use in the production process for a dispersion of particles of substantially light-insensitive organic silver salt in an aqueous medium are:

Surfactant Nr. 1=MARLON™ A-396, a sodium alkylphenylsulfonate from Hütls;

Surfactant Nr. 2=ammonium 4-dodecylbenzene sulfonate;

Surfactant Nr. 3=HOSTAPALT™ B, a sodium trisalkylphenyl-polyethyleneglycol(EO 7-8)sulphate from Hoechst.

Organic reducing agent

Suitable organic reducing agents for the reduction of the substantially light-insensitive organic heavy metal salts are organic compounds containing at least one active hydrogen atom linked to O, N or C. Particularly suitable organic reducing agents for the reduction of the substantially light-insensitive organic silver salt, an organic reducing agent for the substantially light-insensitive organic silver salt are non-sulfo-substituted 6-membered aromatic or heteroaromatic ring compounds with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annulated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substituent is an amino-group.

Particularly preferred reducing agents are substituted catechols or substituted hydroquinones with 3-(3',4'-dihydroxyphenyl)-propionic acid, 3',4'-dihydroxybutyrophenone, methyl gallate, ethyl gallate and 1,5-dihydroxy-naphthalene being especially preferred.

Other suitable reducing agents, particularly for photothermographic recording materials, are sterically hindered phenols, bisphenols and sulfonamidophenols.

Combinations of reducing agents may also be used that on heating become reactive partners in the reduction of the substantially light-insensitive organic silver salt comprising silver behenate. For example, combinations of reducing agents with sulfonamidophenols are described in the periodical Research Disclosure, February 1979, item 17842, in U.S. Pat. Nos. 4,360,581 and 4,782,004, and in EP-A 423 891 and combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5.545.507 and U.S. Pat. No. 5,558,983; acrylonitrile compounds as disclosed in U.S. Pat. No. 5,545,515 and U.S. Pat. No. 5,635,339; and 2-substituted malondialdehyde compounds as disclosed in U.S. Pat. No. 5,654,130. Organic reducing metal salts, e.g. stannous stearate, have also been used in such reducing agent combinations, as disclosed in U.S. Pat. Nos. 3,460,946 and 3,547,648. Sterically hindered phenols and bisphenols have themselves been used in such reducing agent combinations, such as described in U.S. Pat. No. 4,001,026 and U.S. Pat. No. 3,547,648 respectively.

The silver image density depends on the coverage of the above defined reducing agent(s) and organic silver salt(s) and has to be preferably such that, on heating above 100° C., an optical density of at least 2.5 can be obtained. Preferably at least 0.10 moles of reducing agent per mole of organic silver salt is used.

During the thermal development process the reducing agent must be present in such a way that it is able to diffuse to the substantially light-insensitive organic silver salt particles so that reduction of the substantially light-insensitive organic silver salt can take place.

Spectral Sensitizer

The photo-addressable thermally developable element of the photothermographic recording material, according to the present invention, may contain a spectral sensitizer, optionally together with a supersensitizer, for the silver halide appropriate for the wavelength of the light source which may in the near UV, visible, e.g. 630 nm, 670 nm etc., or IR, parts of spectrum. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

Supersensitizers

According to the present invention the photothermographic recording material may further includes a supersensitizer. Preferred supersensitzers are selected from the group of compounds consisting of: mercapto-compounds, disulfide-compounds, stilbene compounds, organoborate compounds and styryl compounds.

Binders for the Photo-addressable Thermally Developable Element

The film-forming binder of the photo-addressable thermally developable element may be all kinds of natural, modified natural or synthetic resins or mixtures of such resins: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

A particularly suitable polyvinyl butyral containing a minor amount of vinyl alcohol units is marketed under the trade name BUTVART™ B79 of Monsanto USA and provides a good adhesion to paper and properly subbed polyester supports.

The layer containing the organic silver salt is commonly coated onto a support in sheet- or web-form from an organic solvent containing the binder dissolved therein, but may also be applied from an aqueous medium containing a water-dispersible binder and/or a water dispersible binder.

Suitable water-soluble film-forming binders for use in thermographic and photothermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders such as gelatin, modified gelatins such as phthaloyl gelatin, polysaccharides, such as starch, gum arabic and dextran and water-soluble cellulose derivatives. A preferred water-soluble binder for use in the thermographic and photothermographic recording materials of the present invention is gelatin.

Suitable water-dispersible binders for use in the thermographic and photothermographic recording materials of the present invention may be any water-insoluble polymer e.g. water-insoluble cellulose derivatives, polyurethanes, polyesters polycarbonates and polymers derived from c,p-ethylenically unsaturated compounds such as after-chlorinated polyvinyl chloride, partially hydrolyzed polyvinyl acetate, polyvinyl alcohol, polyvinyl acetals preferably polyvinyl butyral, and homopolymers and copolymers produced using monomers selected from the group consisting of: vinyl chloride, vinylidene chloride, acrylonitrile, acrylamides, methacrylamides. methacrylates, acrylates, methacrylic acid, acrylic acid, vinyl esters, styrenes, dienes and alkenes; or mixtures thereof. It should be noted that there is no clear cut transition between a polymer dispersion and a polymer solution in the case of very small polymer particles resulting in the smallest particles of the polymer being dissolved and those slightly larger being in dispersion.

Preferred water-dispersible binders for use according to the present invention are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders for use according the present invention are water-dispersible film-forming polymers with covalently bonded moieties with one or more acid groups.

Water-dispersible binders with crosslinkable groups, e.g. epoxy groups, aceto-acetoxy groups and crosslinkable double bonds are also preferred. Preferred water-dispersible binders for use in the thermographic and photothermographic recording materials of the present invention are polymer latexes. For use as a latex the dispersible polymer has preferably some hydrophilic functionality.

The binder to organic silver salt weight ratio is preferably in the range of 0.2 to 6, and the thickness of the recording layer is preferably in the range of 5 to 50 μm.

Thermal Solvent

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C.

Toning Agent

In order to obtain a neutral black image tone in the higher densities and neutral grey in the lower densities the recording layer contains preferably in admixture with the organic heavy metal salts and reducing agents a so-called toning agent known from thermography or photothermography. Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB-P 1,439,478, U.S. Pat. No. 3,951,660 and U.S. Pat. No. 5,599,647. A toner compound particularly suited for use in combination with polyhydroxy benzene reducing agents is 3,4-dihydro-2,4-dioxo-1,3,2H-benzoxazine described in U.S. Pat. No. 3,951,660.

Antihalation Dyes

In addition to the ingredients, the photothermographic recording material of the present invention may contain antihalation or acutance dyes which absorb light which has passed through the photosensitive layer which may in the near UV, visible, e.g. 630 nm, 670 nm etc., or IR, parts of spectrum, thereby preventing its reflection. Such dyes may be incorporated into the photo-addressable thermally developable element or in any other layer comprising the photothermographic recording material of the present invention.

Surfactants

Non-ionic, cationic or anionic surfactants may be used, according to the present invention, to produce dispersions of particles of the substantially light-insensitive silver salt of an organic carboxylic acid in aqueous media and to disperse water-dispersible binders, such as polymer latexes, in aqueous media. A mixture of non-ionic and anionic surfactants, of non-ionic and cationic surfactants, of cationic and anionic surfactants or of non-ionic, cationic and anionic surfactants may also be used, according to the present invention.

In one embodiment of the present invention the surfactant is an anionic surfactant. In a preferred embodiment of the present invention the anionic surfactant is a sulfonate e.g.

alkyl, aryl, alkaryl or aralkyl sulfonate, with alkyl and alkaryl sulfonates being particularly preferred.

In a further embodiment of the present invention the ionic surfactant is a non-ionic surfactant for example alkyl, aryl, alkaryl or aralkyl polyethoxy ethanols. Preferred non-ionic surfactants, according to the present invention, are alkoxy-polyethoxy ethanols and alkaryloxy-polyethoxy ethanols.

Other Additives

In addition to the ingredients the photo-addressable thermally developable element may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Ö 1 A (tradename of BAYER AG-GERMANY), ultraviolet light absorbing compounds, white light reflecting and/or ultraviolet radiation reflecting pigments, silica, colloidal silica, fine polymeric particles [e.g. of poly(methylmethacrylate)] and/or optical brightening agents.

Support

The support for the photothermographic recording material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. For example, a paper base substrate is present which may contain white reflecting pigments, optionally also applied in an interlayer between the recording material and the paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

One or more backing layers may be provided to control physical properties such as curl or static.

Outermost Layer

The outermost layer of the recording material may in different embodiments of the present invention be the outermost layer of the thermosensitive element, a protective layer applied to the thermosensitive element or a layer on the opposite side of the support to the thermosensitive element.

Protective Layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

The protective layer preferably comprises a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer.

A protective layer according to the present invention may comprise in addition a thermomeltable particle optionally with a lubricant present on top of the protective layer as described in WO 94/11199. In a preferred embodiment at least one solid lubricant having a melting point below 150° C. and at least one liquid lubricant in a binder is present, wherein at least one of the lubricants is a phosphoric acid derivative.

Water-soluble or Water-dispersible Binder for Outermost Layer

According to an embodiment of the present invention the outermost layer of the recording material may comprise a water-soluble binder, a water-dispersible binder or a mixture of a water-soluble and a water-soluble binder. Suitable water-soluble binders for the outermost layer are, for example, gelatin, polyvinylalcohol, cellulose derivatives or other polysaccharides, hydroxyethyl-cellulose, hydroxypropylcellulose etc., with hardenable binders being preferred and polyvinylalcohol being particularly preferred. Suitable water-dispersible binders are polymeric latexes.

Crosslinking Agents for Outermost Layer

The outermost layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

Matting Agents for Outermost Layer

The outermost layer of the recording material according to the present invention may comprise a matting agent. Suitable matting agents are described in WO 94/11198 and include e.g. talc particles and optionally protrude from the outermost layer.

Lubricants for Outermost Layer

Solid or liquid lubricants or combinations thereof are suitable for improving the slip characteristics of the recording materials according to the present invention.

Solid lubricants which can be used according to the present invention are polyolefin waxes, ester waxes, polyolefin-polyether block copolymers, amide waxes, polyglycols, fatty acids, fatty alcohols, natural waxes and solid phosphoric acid derivatives. Preferred solid lubricants are thermomeltable particles such as those described in WO 94/11199.

Liquid lubricants which can be used according to the present invention according to the present invention are fatty acid esters such as glycerine trioleate, sorbitan monooleate and sorbitan trioleate, silicone oil derivatives and phosphoric acid derivatives.

Antistatic Layer

In a preferred embodiment the recording material of the present invention an antistatic layer is applied to the outermost layer on the side of the support not coated with the photo-addressable thermally developable element. Suitable antistatic layers therefor are described in EP-A's 444 326, 534 006 and 644 456, U.S. Pat. Nos. 5,364,752 and 5,472,832 and DOS 4125758.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Photothermographic Recording Process

Photothermographic materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermo-graphic recording materials, according to the present invention, any sort of heat source can be used that enables the recording materials to be uniformly heated to the development temperature in a time acceptable for the application concerned e.g. contact heating, radiative heating, microwave heating etc.

Applications

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field photothermographic recording materials on a white opaque base are used, in the graphics field black-imaged transparencies are used as masks and in the medical diagnostic field black-imaged transparencies are widely used in inspection techniques operating with a light box.

The invention is illustrated hereinafter by way of invention examples and comparative examples. The percentages and ratios given in these examples are by weight unless otherwise indicated. The ingredients used in the invention and comparative examples, other than those mention ed above, are:

as organic silver salt:

AgB=silver behenate;

as binders:

R16875=type R16875, a phthaloyl gelatin from ROUSSELOT;

LATEX 01=a latex of a terpolymer of 47.5% by weight of butadiene, 47.5% by weight of methyl methacrylate and 5% by weight of itaconic acid;

R01=3(3',4'-dihydroxyphenyl)propionic acid, as reducing agent

TA01=phthalazine, as a t oning agent; and

BMPS=phenyl tribromomethyl sulfone.

INVENTION EXAMPLES 1 & 2 and COMPARATIVE EXAMPLES 1 & 2

Preparation of Silver Behenate Dispersions in an Aqueous Medium in the Absence of Organic Solvent Using a Single jet Process The type I aqueous dispersion of silver behenate used in INVENTION EXAMPLES 1 & 2 and COMPARATIVE EXAMPLES 1 & 2 was produced as follows:

i) dispersing 136.2 g (0.4 M) behenic acid with stirring at 310 rpm wit h a 80 mm diameter typhoon stirrer in a 200 mm in diameter vessel at 80° C. in a quantity of 549 mL of a 10% solution of Surfactant nr 1 and 662 g of deionized water at a temperature of 80° C.;

ii) then adding 188 mL of a 2M aqueous solution of sodium hydroxide with stirring at 310 rpm with a 80 mm diameter typhoon stirrer to the 200 mm in diameter vessel at 80° C. over a period of 10 minutes to produce a clear solution substantially containing sodium behenate;

iii) then adding a 360 mL of a 1M aqueous solution of silver nitrate with stirring at 310 rpm with a 80 mm diameter typhoon stirrer to the 200 mm in diameter vessel at a temperature of 80° C. over a period of 4.5 minutes to convert the sodium behenate completely into silver behenate. The aqueous silver behenate dispersion obtained contained 8.15% by weight of silver behenate and 2.78% by weight of Surfactant 1.

Preparation of Ex-situ Photosensitive Silver Halide

The type 01 silver halide emulsion consisting of 3.11% by weight of silver halide particles consisting of 97 mol % silver bromide and 3 mol % silver iodide with a weight average particle size of 50 nm, 0.47% of R16875 as dispersing agent in deionized water was prepared using conventional silver halide preparation techniques such as described, for example, in T. H. James, "The Theory of the Photographic Process", Fourth Edition, Macmillan Publishing Co. Inc., New York (1977), Chapter 3, pages 88–104 and at least 80% of the particles by number had a diameter determined by electron microscopy between 40 and 100 nm.

Coating Dispersions

The coating dispersions for the photothermographic recording materials of INVENTION EXAMPLES 1 & 2 and COMPARATIVE EXAMPLES 1 & 2 were produced with stirring by optionally mixing silver halide dispersion type 01 with silver behenate dispersion type I in the quantity specified in table 1, then optionally adding potassium iodide as a 3.63% by weight aqueous solution in the molar quantity specified in table 1, then adding LATEX 01 as a 30% by weight aqueous dispersion in an equal weight to the quantity of silver behenate present, then adding TA01 as a 5.6% by weight aqueous solution in a quantity of 20 mol % of the silver behenate present and finally adding R01 as a 5.6% by weight aqueous solution in a quantity of 45 mol % of the silver behenate present.

Coating With the Photo-addressable Thermally Developable Element

A subbed polyethylene terephthalate support having a thickness of 100 $\mu$m was doctor blade-coated with the particular silver behenate/silver halide dispersion for the photothermographic recording material of the particular EXAMPLE at a blade setting of 120 μm. The resulting photothermographic recording material was first allowed to dry on the coating bed for several minutes at 40° C. and then was dried in a hot air oven at 40° C. for 1 h to produce a photo-addressable thermally developable element with a ca. 5 g/m$^2$ coating weight of silver behenate.

Image-wise Exposure and Thermal Processing

The photothermographic materials of INVENTION EXAMPLES 1 & 2 and COMPARATIVE EXAMPLES 1 & 2 were then exposed through a test original in contact with the material in an Agfa-Gevaert™ DL 2000 exposure apparatus equipped with a V405 filter (with transmission for UV wavelengths between 390 and 440 nm) followed by heating on a metal block for 5 s at 105° C. to produce a very good image with a high contrast and good sharpness.

Image Evaluation

The optical maximum and minimum densities of the prints obtained with the recording materials of INVENTION EXAMPLES 1 & 2 and COMPARATIVE EXAMPLES 1 & 2 measured through a visual filter with a Macbeth™ TR924 densitometer and the difference, representing the contrast obtained, is given for the photothermographic recording materials of INVENTION EXAMPLES 1 & 2 and COMPARATIVE EXAMPLES 1 & 2 in table 1 below.

TABLE 1

| | AgB dispersion | ex-situ AgX dispersion | | in-situ AgI | | | Imaging characteristics | |
|---|---|---|---|---|---|---|---|---|
| Example | dispersion type | type | mol % AgX | $I^-$ source | mol % $I^-$-source vs AgB | mol AgI per mole ex-situ AgX | Sensitivity at D = $D_{min}$ + 1 [J/m$^2$] | $D_{max} - D_{min}$ |
| Comparative 1 | I | 01 | 0 | KI | 8 | — | 0.63 | 1.92 |
| Comparative 2 | I | 01 | 8 | — | — | — | 0.58 | 1.54 |
| Invention 1 | I | 01 | 8 | KI | 4 | 0.5 | 0.16 | 2.24 |
| Invention 2 | I | 01 | 8 | KI | 8 | 1.0 | 0.089 | 1.82 |

The results in table 1 show that the photothermographic recording materials of INVENTION EXAMPLES 1 & 2 in which in-situ silver halide formation has taken place with potassium iodide in the presence of ex-situ silver halide exhibit a surprising superadditive increase in sensitivity i.e. a superadditive reduction in the exposure required to achieve a density $D=D_{min}+1.0$ compared with the photothermographic recording materials of COMPARATIVE EXAMPLE 1 with only in-situ formed photosensitive silver halide and COMPARATIVE EXAMPLE 2 with only ex-situ photosensitive silver halide tetother. Furthermore, the photosensitivity of the photothermographic material of INVENTION EXAMPLE 2 with 1.0 mole of in-situ produced silver iodide per mole ex-situ silver halide was markedly higher than that observed with the photothermographic material of INVENTION EXAMPLE 1 with 0.5 mole of in-situ produced silver iodide per mole ex-situ silver halide.

INVENTION EXAMPLES 3 to 7 and COMPARATIVE EXAMPLE 3

The photothermographic recording materials of INVENTION EXAMPLES 3 to 7 and COMPARATIVE EXAMPLE 3 were prepared as described for the photothermographic recording materials of INVENTION EXAMPLES 1 & 2 and COMPARATIVE EXAMPLES 1 & 2 except as given in table 2 below.

The photothermographic processing of the photothermographic recording materials of INVENTION EXAMPLES 3 to 7 and COMPARATIVE EXAMPLE 3 was also carried out as described above for INVENTION EXAMPLES 1 & 2 and COMPARATIVE EXAMPLES 1 & 2. The results are summarized in table 2 below.

TABLE 2

| | AgB dispersion | ex-situ AgX vs AgB | | dispersion in-situ AgI | | | Imaging characteristics | |
|---|---|---|---|---|---|---|---|---|
| Example | dispersion type | type | mol % AgX | $I^-$ source | mol % $I^-$-source vs AgB | mol AgI/mole ex-situ AgX | Sensitivity at D = $D_{min}$ + 1 [J/m$^2$] | $D_{max} - D_{min}$ |
| Comparative 3 | I | — | — | PC01 | 7.9 | — | 1.0 | 2.14 |
| Invention 3 | I | 01 | 8 | PC01 | 8 | 1.0 | 0.063 | 2.06 |
| Invention 4 | I | 01 | 4.6 | PC01 | 3.9 | 0.85 | 0.32 | 1.74 |
| Invention 5 | I | 01 | 10.2 | PC01 | 3.9 | 0.38 | 0.16 | 2.50 |
| Invention 6 | I | 01 | 12 | PC01 | 3.9 | 0.325 | 0.10 | 2.56 |
| Invention 7 | I | 01 | 19.5 | PC01 | 3.9 | 0.2 | 0.079 | 2.36 |

The results in table 2 show that the photothermographic recording materials of INVENTION EXAMPLES 3 to 7 in which in-situ silver halide formation has taken place with 3-(triphenyl-phosphonium)propionic acid iodide (PC01) in the presence of ex-situ silver halide exhibit a superadditive increase in sensitivity i.e. a superadditive reduction in exposure to achieve a density $D=D_{min}+1.0$ compared with the photothermographic recording materials of COMPARATIVE EXAMPLE 3 with only in-situ formed photosensitive silver halide with PC01 and the photothermographic recording material of COMPARATIVE EXAMPLE 2 together. Moreover the results with the photothermographic recording materials of INVENTION EXAMPLES 4 to 7 show that for a constant degree of in-situ silver halide formation there is an increase in sensitivity and contrast ($D_{max}-D_{min}$) upon increasing the quantity of ex-situ silver halide.

INVENTION EXAMPLES 8 to 10 and COMPARATIVE EXAMPLE 4

Preparation of a Silver Behenate/silver Halide Dispersion Type II in an Aqueous Medium in the Absence of Organic Solvent Using a Single Jet Process The type II aqueous dispersion of silver behenate/silver halide used in INVENTION EXAMPLES 8 to 10 and COMPARATIVE EXAMPLE 4 was produced as described above for the type I aqueous dispersion of silver behenate except that 45.43 g of silver halide dispersion type 01 was added to the solution consisting substantially of sodium behenate [between steps ii) and iii)]. The aqueous silver behenate dispersion obtained contained 8.03% by weight of silver behenate, 2.74% by weight of Surfactant 1, 0.27% by weight of $AgBr_{0.97}I_{0.03}$ and 0.04% of R16875.

Coating Dispersions and Coating Thereof

The coating dispersions were prepared and coated as described for the preparation of the photothermographic recording material of INVENTION EXAMPLES 1 & 2 and COMPARATIVE EXAMPLES 1 & 2 except as mentioned in table 3.

Photothermographic Processing

The photothermographic processing of the photothermographic recording materials of INVENTION EXAMPLES 8 to 10 and COMPARATIVE EXAMPLE 4 was carried out as described for INVENTION EXAMPLES 1 & 2 and COMPARATIVE EXAMPLES 1 & 2. The results are summarized in table 3.

TABLE 3

| | AgB | ex-situ AgX | | dispersion | | | Imaging characteristics | |
|---|---|---|---|---|---|---|---|---|
| | dis- | vs | | in-situ AgI | | | Sensitivity | |
| Example | per-sion type | type | AgB mol % AgX | $I^-$ source | mol % $I^-$-source vs AgB | mol AgI/mole ex-situ AgX | at D = $D_{min}$ + 1 [J/m$^2$] | $D_{max} - D_{min}$ |
| Comparative 4 | II | — | 8 | — | — | — | 0.58 | 1.19 |
| Invention 8 | II | 01 | 8 | PC01 | 2 | 0.25 | 0.28 | 1.44 |
| Invention 9 | II | 01 | 8 | KI | 4.7 | 0.59 | 0.19 | 1.60 |
| Invention 10 | II | 01 | 8 | PC01 | 8 | 1.0 | 0.13 | 1.44 |

The results in table 3 show that the photothermographic recording materials of INVENTION EXAMPLES 8 to 10 in which in-situ silver halide formation has taken place with 3-(triphenyl-phosphonium)propionic acid iodide (PC01) or potassium iodide in the presence of ex-situ silver halide which was present during the silver behenate synthesis exhibit increased sensitivities i.e. reduced exposures to achieve a density $D=D_{min}+1.0$ and increased contrast ($D_{max}-D_{min}$) compared with the photothermographic recording material of COMPARATIVE EXAMPLE 4 with only ex-situ formed photosensitive silver halide present during the silver behenate synthesis. Furthermore, the photosensitivities of the photothermographic materials of INVENTION EXAMPLE 8 to 10 increase with increasing concentration of in-situ produced silver iodide per mole ex-situ silver halide from 0.28 J/m$^2$ for the photothermographic material of INVENTION EXAMPLE 8 with 0.25 moles in-situ silver halide per mole ex-situ silver halide to 0.13 J/m$^2$ for the photothermographic material of INVENTION EXAMPLE 10 with 1.0 moles in-situ silver halide per mole ex-situ silver halide.

INVENTION EXAMPLES 11 to 20 and COMPARATIVE EXAMPLE 5

The photothermographic recording materials of INVENTION EXAMPLES 11 to 20 and COMPARATIVE EXAMPLE 5 were prepared as described for the photothermographic recording materials of INVENTION EXAMPLES 1 & 2 and COMPARATIVE EXAMPLES 1 & 2 except as given in table 4 below. The BMPS was added as an aqueous dispersion unless otherwise mentioned.

The photothermographic processing of the photothermographic recording materials of INVENTION EXAMPLES 11 to 20 and COMPARATIVE EXAMPLE 5 was also carried out as described above for INVENTION EXAMPLES 1 & 2 and COMPARATIVE EXAMPLES 1 & 2. The results are summarized in table 4 below together with the results for the photothermographic recording material of INVENTION EXAMPLE 1.

TABLE 4

| Example | AgB dispersion type | ex-situ AgX dispersion type | mol % AgX vs AgB | in-situ AgI $I^-$ source | mol % $I^-$ source vs AgB | mol AgI/mole ex-situ AgX | concentration of BMPS [mol % vs AgB] | Imaging characteristics Sensitivity at $D = D_{min} + 1$ [J/m$^2$] | $D_{max} - D_{min}$ |
|---|---|---|---|---|---|---|---|---|---|
| Comparative 5 | I | 01 | 6.7 | — | — | — | 7.1 | 0.63 | 2.25 |
| Invention 11 | I | 01 | 6.7 | KI | 3.8 | 0.57 | 0 | 0.13 | 2.22 |
| Invention 12 | I | 01 | 6.7 | KI | 3.8 | 0.57 | 7.1 | 0.045 | 2.46 |
| Invention 13 | I | 01 | 6.7 | KI | 3.8 | 0.57 | 3.2 | 0.040 | 2.98 |
| Invention 14 | I | 01 | 6.7 | KI | 3.8 | 0.57 | 11.2 | 0.050 | 2.68 |
| Invention 1 | I | 01 | 9 | KI | 3.8 | 0.42 | 0 | 0.16 | 2.24 |
| Invention 15 | I | 01 | 9 | KI | 3.8 | 0.42 | 3.7 | 0.063 | 2.92 |
| Invention 16 | I | 01 | 9 | KI | 3.8 | 0.42 | 5.6 (propanone solution) | 0.063 | 2.90 |
| Invention 17 | I | 01 | 9 | KI | 3.8 | 0.42 | 14.9 | 0.032 | 2.96 |
| Invention 18 | I | 01 | 9 | KI | 3.8 | 0.42 | 22.4 | 0.032 | 2.22 |
| Invention 19 | I | 01 | 9 | KI | 7.7 | 0.86 | 0 | 0.063 | 2.35 |
| Invention 20 | I | 01 | 9 | KI | 7.7 | 0.86 | 6.7 | 0.050 | 3.03 |

The results in table 4 show that the photothermographic recording materials of INVENTION EXAMPLES 1, 11 and 19 in which in-situ silver halide formation has taken place with potassium iodide in the presence of ex-situ silver halide exhibit a superadditive increase in sensitivity i.e. a superadditive reduction in exposure to achieve a density $D=D_{min}+1.0$ compared with the photothermographic recording material of COMPARATIVE EXAMPLE 5 with only ex-situ formed photosensitive silver halide and the photothermographic recording material of COMPARATIVE EXAMPLE 1 with in-situ formed silver halide together. Addition of BMPS, as in the photothermographic recording materials of INVENTION EXAMPLES 12 to 18 and 20, produces an additional increase in both sensitivity i.e. reduced exposures to achieve a density $D=D_{min}+1.0$ together with a strong increase in contrast ($D_{max}-D_{min}$). This increase in sensitivity and contrast increased with increasing BMPS-concentration up to a BMPS-concentration of ca. 15 mol % versus silver behenate.

INVENTION EXAMPLES 21 to 27 and COMPARATIVE EXAMPLE 6

Preparation of Ex-situ Photosensitive Silver Halide

The types 02 to 05 silver halide emulsions were prepared as described for the type 01 silver halide emulsion used in the preparation of the photothermographic materials of INVENTION EXAMPLES 1 & 2 and COMPARATIVE EXAMPLES 1 & 2 except for the differences in composition, silver halide concentration and R16875 concentration given in table 5

TABLE 5

| AgX dispersion type | AgX-composition | concentration of AgX [wt %] | concentration of R16875 [wt %] |
|---|---|---|---|
| 02 | $AgBr_{0.92}I_{0.08}$ | 3.11 | 0.47 |
| 03 | $AgBr_{0.85}I_{0.15}$ | 3.11 | 0.47 |
| 04 | AgI | 3.11 | 0.47 |
| 05 | AgBr | 3.11 | 0.47 |

The photothermographic recording materials of INVENTION EXAMPLES 21 to 27 and COMPARATIVE EXAMPLE 6 were prepared as described for the photothermographic recording materials of INVENTION EXAMPLES 1 & 2 and COMPARATIVE EXAMPLES 1 & 2 except as given in table 4 below. The BMPS was added as an aqueous dispersion.

Transmission Electron Micrographs Showing the Influence of In-situ Silver Iodide Formation and the Additional Influence of BMPS on a Silver Behenate/ex-situ Silver Halide Dispersion FIG. 1 shows a transmission electron micrograph of the silver behenate/ex-situ silver halide dispersion used in the preparation of the photothermographic recording material of COMPARATIVE EXAMPLE 6 produced at a magnification of 100,000×(1 cm=100 nm).

FIG. 2 shows a transmission electron micrograph of the silver behenate/ex-situ silver halide dispersion shown in FIG. 1 to which 3.7 mol % with respect to the silver behenate present of potassium iodide has been added as in the preparation of the photothermographic recording material of INVENTION EXAMPLE 21 produced at a magnification of 100,000×(1 cm=100 nm). It is clear from a comparison of FIGS. 1 and 2 that the small black aggregates of silver halide particle are present as large clusters in the dispersion shown in FIG. 1 have become smaller and better dispersed in the dispersion shown in FIG. 2.

FIG. 3 shows a transmission electron micrograph of the silver behenate/ex-situ silver halide dispersion with a slightly higher silver halide concentration than that shown in FIG. 1 to which 4.0 mol % with respect to the silver behenate present of potassium iodide has been added, in analogy with the dispersion shown in FIG. 2, and to which in addition 8.20 mol % with respect to the silver behenate present of BMPS has been added as in the preparation of the photothermographic recording material of INVENTION EXAMPLE 22 produced at a magnification of 100,000×(1 cm=100 nm). It is clear from a comparison of FIGS. 2 and 3 that significant further deaggregation of the silver halide aggregates has taken place in the dispersion shown in FIG. 3 compared with the dispersion shown in FIG. 2 and hence that the silver halide particles have become even better dispersed.

The photothermographic processing of the photothermographic recording materials of INVENTION EXAMPLES 21 to 27 and COMPARATIVE EXAMPLE 6 was also carried out as described above for INVENTION EXAMPLES 1 & 2 and COMPARATIVE EXAMPLES 1 & 2. The results are summarized in table 6 below.

The results in table 6 show that the photothermographic recording materials of INVENTION EXAMPLES 21 to 27 in which in-situ silver halide formation has taken place with potassium iodide in the presence of ex-situ silver halide exhibit strongly increased sensitivities i.e. reduced exposures to achieve a density $D=D_{min}+1.0$ compared with the photothermographic recording material of COMPARATIVE EXAMPLE 6 with only ex-situ formed photosensitive silver halide. With EMPS there was an additional increase in both sensitivity i.e. reduced exposures to achieve a density $D=D_{min}+1.0$ and contrast ($D_{max}-D_{min}$) which further increased with increasing BMPS-concentration up to a BMPS-concentration with all the ex-situ silver halide dispersions used regardless of the composition of the silver halide.

INVENTION EXAMPLES 28 & 29 and COMPARATIVE EXAMPLES 7 & 8

Preparation of Type III Silver Behenate Dispersion

Silver behenate for the type III silver behenate dispersion was prepared by dissolving 34 g (0.1 moles) of behenic acid in 340 mL of 2-propanol at 65° C., converting the behenic acid to sodium behenate by adding 400 mL of 0.25 M aqueous sodium hydroxide to the stirred behenic acid solution and finally adding 250 mL of 0.4 M aqueous silver nitrate the silver behenate precipitating out. This was filtered off and then washed with a mixture of 10% by volume of 2-propanol and 90% by volume of deionized water to remove residual sodium nitrate. The silver behenate was then dried at 45° C. for 12 h.

The type III silver behenate dispersion used in producing the photothermographic recording materials of COMPARATIVE EXAMPLE 7 and INVENTION EXAMPLE 28 was obtained by dispersing the dried silver behenate powder in deionized water with the anionic dispersion agent Surfactant Nr 1 to produce, after rapid mixing to a predispersion and homogenization with a microfluidizer, a finely divided and stable dispersion containing 20% by weight of silver behenate, 2.0% by weight of Surfactant Nr 1. The pH of the resulting dispersion was adjusted to about 6.5.

Preparation of Type IV Silver Behenate

The silver behenate for the type IV dispersion was prepared by dissolving the required quantity of behenic acid in 2-butanone at 60° C. with vigorous stirring followed by adding demineralized water while maintaining the reactor at a temperature of between 56 and 60° C., converting the behenic acid into 110.9 moles of sodium behenate, at the concentration of 0.1M, by adding an aqueous solution of sodium hydroxide with vigorous stirring while maintaining the temperature of the reactor at a temperature between 56 and 60° C. and finally converting the sodium behenate into silver behenate by adding 55.45 moles of silver nitrate as a 1.67M aqueous solution in 3 minutes and then 55.45 moles of silver nitrate as a 1.67M aqueous solution in 15 minutes

TABLE 6

| | AgB | ex-situ AgX dispersion | | | | | concen- | Imaging characteristics | |
|---|---|---|---|---|---|---|---|---|---|
| | dis- | | mol % | in-situ AgI | | | tration | Sensit- | |
| Example | per-sion type | type | AgX vs AgB | $I^-$ source | mol % $I^-$ source vs AgB | mol AgI/ mole ex-situ AgX | of BMPS [mol % vs AgB] | ivity at $D = D_{min} + 1$ [J/m$^2$] | $D_{max} - D_{min}$ |
| Comparative 6 | I | 02 | 8 | — | — | — | 0 | 0.79 | 1.30 |
| Invention 21 | I | 02 | 8 | KI | 3.7 | 0.46 | 0 | 0.11 | 2.40 |
| Invention 22 | I | 02 | 8.6 | KI | 4.0 | 0.47 | 8.20 | 0.063 | 3.08 |
| Invention 23 | I | 03 | 9.2 | KI | 4.0 | 0.43 | 0 | 0.11 | 2.32 |
| Invention 24 | I | 03 | 9.2 | KI | 4.0 | 0.43 | 7.5 | 0.045 | 3.36 |
| Invention 25 | I | 04 | 8.5 | KI | 3.5 | 0.41 | 0 | 0.079 | 2.41 |
| Invention 26 | I | 04 | 8.5 | KI | 3.8 | 0.45 | 7.5 | 0.063 | 3.38 |
| Invention 27 | I | 05 | 3.9 | KI | 8.9 | 2.28 | 0 | 0.12 | 1.87 |

with vigorous stirring while maintaining the reactor temperature at a temperature of 55° C. The final percentage by weight of 2-butanone in the suspending mixture of 2-butanone and water was 45%.

The type IV silver behenate dispersion used in COMPARATIVE EXAMPLE 8 and INVENTION EXAMPLE 29 was obtained by dispersing the dried silver behenate with Surfactant Nr 1 in deionized water to produce, after rapid mixing to a predispersion and homogenization with a microfluidizer, a finely divided and stable dispersion containing 20% by weight of silver behenate and 2.0% by weight of Surfactant Nr 1. The pH of the resulting dispersion was adjusted to about 6.5.

The photothermographic recording materials of INVENTION EXAMPLES 28 & 29 and COMPARATIVE EXAMPLES 7 & 8 were prepared as described for the photothermographic recording materials of INVENTION EXAMPLES 1 & 2 and COMPARATIVE EXAMPLES 1 & 2 except as given in table 7 below. The photothermographic processing of the photothermographic recording materials of INVENTION EXAMPLES 28 & 29 and COMPARATIVE EXAMPLES 7 & 8 was also carried out as described above for INVENTION EXAMPLES 1 & 2 and COMPARATIVE EXAMPLES 1 & 2. The results are summarized in table 7 below.

TABLE 7

| | AgB | ex-situ AgX dispersion | | | | | concen- | Imaging characteristics | |
|---|---|---|---|---|---|---|---|---|---|
| | dis- | | mol % | in-situ AgI | | | tration | Sensit- | |
| Example | per-sion type | type | AgX vs AgB | $I^-$ source | mol % $I^-$ source vs AgB | mol AgI/ mole ex-situ AgX | of BMPS [mol % vs AgB] | ivity at $D = D_{min} + 1$ [J/m$^2$] | $D_{max} - D_{min}$ |
| Comparative 7 | III | 02 | 8.8 | — | — | — | 0 | 1.12 | 1.75 |
| Invention 28 | III | 02 | 8.8 | PC01 | 4.0 | 0.45 | 0 | 0.20 | 3.33 |
| Comparative 8 | IV | 02 | 8.6 | — | — | — | 0 | 1.26 | 1.51 |
| Invention 29 | IV | 02 | 8.6 | PC01 | 4.0 | 0.465 | 0 | 0.079 | 2.77 |

The results in table 7 show that the photothermographic recording materials of INVENTION EXAMPLES 28 & 29 each prepared using a silver behenate dispersion prepared under different water/solvent preparation conditions and in which in-situ silver halide formation has taken place with PC01 in the presence of ex-situ silver halide exhibit strongly increased sensitivities i.e. reduced exposures to achieve a density $D=D_{min}+1.0$ and contrast ($D_{max}-D_{min}$) compared with the photothermographic recording materials of the corresponding COMPARATIVE EXAMPLE 7 and 8 respectively with only ex-situ formed photosensitive silver halide.

INVENTION EXAMPLE 30 and COMPARATIVE EXAMPLE 9

The photothermographic recording materials of INVENTION EXAMPLE 30 and COMPARATIVE EXAMPLE 9 were prepared as described for the photothermographic recording materials of INVENTION EXAMPLES 1 & 2 and COMPARATIVE EXAMPLES 1 & 2 except as given in table 8 below and that the photo-addressable thermally developable element of the photothermographic recording material of INVENTION EXAMPLE 30 consisted of two layers one with in-situ formed silver halide with PC01 and the other with ex-situ silver halide.

The photothermographic processing of the photothermographic recording materials of INVENTION EXAMPLE 30 and COMPARATIVE EXAMPLE 9 was also carried out as described above for INVENTION EXAMPLES 1 & 2 and COMPARATIVE EXAMPLES 1 & 2. The results are summarized together with those for COMPARATIVE EXAMPLE 4 in table 8 below.

TABLE 8

| | | AgB dis- | AgX dis-persion | | in-situ AgX | | Imaging characteristics | |
|---|---|---|---|---|---|---|---|---|
| Example | | per-sion type | type | mol % AgX vs AgB | $X^-$ source | mol % $X^-$ – source vs AgB | Sensitivity at $D = D_{min} + 1$ [J/m$^2$] | $D_{max} - D_{min}$ |
| Comparative 9 | layer 1 | I | — | — | PC01 | 8 | 1.66 | 1.57 |
| Comparative 4 | layer 1 | I | 01 | 8 | — | — | 0.58 | 1.19 |
| Invention 30 | layer 1 | I | — | — | PC01 | 8 | 0.24 | 1.96 |
| | layer 2 | I | 01 | 8 | — | — | | |

The results in table 8 show that the photothermographic recording materials of INVENTION EXAMPLE 30 with two photo-addressable thermally developable layers with in-situ formed photosensitive silver halide using PC01 and ex-situ photosensitive silver halide respectively exhibits a superadditive increase in sensitivity i.e. a superadditive reduction in exposure required to achieve a density $D=D_{min}+1.0$ and contrast ($D_{max}-D_{min}$) compared with the sensitivity and contrast of the photothermographic materials of COMPARATIVE EXAMPLES 4 and 9 with the individual layers comprising the photo-addressable element of the photothermographic material of INVENTION EXAMPLE 30.

COMPARATIVE EXAMPLES 10 to 12 and INVENTION EXAMPLES 31 and 32

The photothermographic recording materials of COMPARATIVE EXAMPLES 10 to 12 and INVENTION EXAMPLES 31 and 32 were prepared as described for the photothermographic recording materials of COMPARATIVE EXAMPLE 7 and INVENTION EXAMPLE 28 except that phthalazine was omitted from the formulation and as given in table 9.

The photothermographic processing of the photothermographic recording materials of COMPARATIVE EXAMPLES 10 to 12 and INVENTION EXAMPLES 31 and 32 was also carried out as described above for INVENTION EXAMPLES 1 & 2 and COMPARATIVE EXAMPLES 1 & 2. The results are summarized in table 9 below.

TABLE 9

| | AgB | ex-situ AgX | | dispersion | | | Imaging characteristics | |
|---|---|---|---|---|---|---|---|---|
| | dis- | vs | | in-situ AgI | | | Sensitivity | |
| Example | per-sion type | type | AgB mol % AgX | $I^-$ source | mol % $I^-$-source vs AgB | mol AgI/mole ex-situ AgX | at $D = D_{min} + 1$ [J/m$^2$] | $D_{max} - D_{min}$ |
| Comparative 10 | III | 05 | 12.3 | PC01 | 1 | 0.08 | >1.5 | 0.77 |
| Comparative 11 | III | 05 | 12.3 | PC01 | 2 | 0.16 | 1.5 | 1.70 |
| Comparative 12 | III | 05 | 8.2 | PC01 | 1 | 0.12 | >1.5 | 0.60 |
| Invention 31 | III | 05 | 4.1 | PC01 | 8 | 1.95 | 0.25 | 2.34 |
| Invention 32 | III | 05 | 9.2 | PC01 | 8 | 0.87 | 0.25 | 1.86 |

The results in table 9 show that the photothermographic recording materials of COMPARATIVE EXAMPLES 10 to 12 with less than 0.2 moles of in-situ silver iodide per mole silver halide and coated from aqueous media exhibited much lower sensitivities than the photothermographic recording materials of INVENTION EXAMPLES 31 and 32 with greater than 0.2 moles of in-situ silver iodide per mole silver halide and coated from aqueous media. This is at variance with the teaching of U.S. Pat. No. 3,871,887 in which the results did not vary between 0.05 and 0.25 moles of silver iodide per mole silver halide in the case of photothermographic materials coated from solvent media.

Having described in detail preferred embodiments of the current invention, it will now be apparent to those skilled in the art that numerous modifications can be made therein without departing from the scope of the invention as defined in the following claims.

What is claimed is:

1. A production process for a photothermographic recording material thermally developable under substantially water-free conditions comprising the steps of: (i) providing a support; (ii) producing one or more aqueous dispersions or solutions containing together a substantially light-insensitive organic silver salt, photosensitive ex-situ silver halide in catalytic association with said substantially light-insensitive organic silver salt, a reducing agent in thermal working relationship with said substantially light-insensitive organic silver salt and a binder; (iii) coating said one or more aqueous dispersions or solutions onto the support to form layers which upon drying become a photo-addressable thermally developable element; wherein said thermally developable element contains between 0.3 and 2.0 moles of in-situ photosensitive silver iodide per mole of ex-situ photosensitive silver halide, said silver iodide being produced by reacting particles of said substantially light-insensitive organic silver salt in an aqueous dispersions with a source of iodide ions, wherein said ex-situ photosensitive silver halide is silver bromide, silver chloride, silver iodide or a mixed crystal containing any combination thereof and said thermally developable element contains a source of bromine or chlorine radicals and wherein said substantially light-insensitive organic silver salt is a silver salt of an organic carboxylic acid.

2. Production process for a photothermographic recording material according to claim 1, wherein said ex-situ photosensitive silver halide and said in-situ photosensitive silver iodide are in catalytic association with said substantially light-insensitive organic silver salt in separate layers.

3. Production process for a photothermographic recording material according to claim 1, wherein said in-situ formed photosensitive silver iodide is formed in the presence of said ex-situ photosensitive silver halide.

4. Production process for a photothermographic recording material according to claim 1, wherein said photo-addressable thermally developable element contains between 0.3 and 1.5 moles of in-situ photosensitive silver iodide per mole of ex-situ photosensitive silver halide.

5. Production process for a photothermographic recording material according to claim 1, wherein said source of bromine radicals is phenyl tribromoethyl sulfone.

6. Production process for photothermographic recording material according to claim 1, wherein said silver salt of said organic carboxylic acid is silver behenate.

7. Production process for a photothermographic recording material according to claim 1, wherein said photosensitive silver halide is present in a concentration with respect to said substantially light-insensitive organic silver salt of between 0.1 and 50 mol %.

8. Production process for a photothermographic recording material according to claim 1, wherein said ex-situ photosensitive silver halide is present in a concentration with respect to said substantially light-insensitive organic silver salt of between 0.1 and 35 mol %.

9. Production process for a photothermographic recording material according to claim 1, wherein said source of bromine radicals is present in a concentration with respect to said substantially light-insensitive organic silver salt of between 1 and 50 mol %.

10. A photothermographic recording material thermally developable under substantially water-free conditions comprising a photo-addressable thermally developable clement comprising a substantially light-insensitive organic silver salt, photosensitive silver halide in catalytic association with said substantially light-insensitive organic silver salt and a reducing agent in thermal working relationship with said substantially light-insensitive organic silver salt and a binder, wherein part of said photosensitive silver halide is ex-situ and part of said silver halide is in-situ and said ex-situ and in-situ photosensitive silver halide is to be found in separate layers, wherein said thermally developable element contains between 0.3 and 2.0 moles of in-situ photosensitive silver iodide per mole of ex-situ photosensitive silver halide, wherein said ex-situ photosensitive silver halide is silver bromide, silver chloride, silver iodide or a mixed crystal containing any combination thereof and said thermally developable element contains a source of bromine or chlorine radicals and wherein said substantially light-insensitive organic silver salt is a silver salt of an organic carboxylic acid.

11. Photothermographic recording material according to claim 10, wherein said thermally developable element contains between 0.3 and 1.5 moles of in-situ photosensitive silver iodide per mole of ex-situ photosensitive silver halide.

12. Photothermographic recording material according to claim 10, wherein said silver salt of said organic carboxylic acid is silver behenate.

13. A recording process comprising the steps of: (i) providing a photothermographic recording material thermally developable under substantially water-free conditions in accordance with claim 10; (ii) bringing said recording material into the proximity of a source of actinic radiation to which it is sensitive; (iii) image-wise exposing said recording material to said actinic radiation; (iv) bringing said image-wise exposed recording material into proximity with a heat source; (v) thermally developing said image-wise exposed recording material under substantially water-free conditions; and (vi) removing said thermally developed image-wise exposed recording material from said heat source.

* * * * *